US010428295B2

(12) United States Patent
Bautista Cid et al.

(10) Patent No.: US 10,428,295 B2
(45) Date of Patent: Oct. 1, 2019

(54) FABRIC WRINKLE REDUCTION COMPOSITION

(71) Applicant: COLGATE-PALMOLIVE COMPANY, New York, NY (US)

(72) Inventors: Oscar Bautista Cid, Mexico City (MX); Enrique Valencia Garcia, Delegación Miguel Hidalgo (MX); Enrique Eduardo Rodriguez Villa, Miguel Hidalgo DF (MX); Jose Javier Tovar Pescador, Mexico City (MX)

(73) Assignee: Colgate-Palmolive Company, New York, NY (US)

( * ) Notice: Subject to any disclaimer, the term of this patent is extended or adjusted under 35 U.S.C. 154(b) by 9 days.

(21) Appl. No.: 15/282,741

(22) Filed: Sep. 30, 2016

(65) Prior Publication Data

US 2017/0022450 A1 Jan. 26, 2017

Related U.S. Application Data

(63) Continuation of application No. 14/241,437, filed as application No. PCT/US2011/051681 on Sep. 15, 2011, now abandoned.

(60) Provisional application No. 61/527,739, filed on Aug. 26, 2011.

(51) Int. Cl.

| | |
|---|---|
| ***C11D 3/37*** | (2006.01) |
| ***C11D 3/00*** | (2006.01) |
| ***C11D 1/62*** | (2006.01) |
| ***C11D 3/20*** | (2006.01) |
| ***C11D 3/30*** | (2006.01) |

(52) U.S. Cl.
CPC ..... *C11D 3/3742* (2013.01); *C11D 1/62* (2013.01); *C11D 3/001* (2013.01); *C11D 3/2086* (2013.01); *C11D 3/30* (2013.01)

(58) Field of Classification Search
CPC ..... C11D 3/001; C11D 3/3742; C11D 1/62; C11D 3/2086; C11D 3/30
See application file for complete search history.

(56) References Cited

U.S. PATENT DOCUMENTS

| | | | | |
|---|---|---|---|---|
| 3,915,867 | A | 10/1975 | Kang et al. | |
| 4,725,635 | A | 2/1988 | Okada et al. | |
| 4,800,026 | A | 1/1989 | Coffindaffer et al. | |
| 4,806,345 | A | 2/1989 | Bhattacharyya | |
| 4,846,982 | A | 7/1989 | Madore et al. | |
| 5,025,076 | A | 6/1991 | Tanaka et al. | |
| 5,062,971 | A | 11/1991 | Coffindaffer et al. | |
| 5,064,543 | A | 11/1991 | Coffindaffer et al. | |
| 5,688,889 | A | 11/1997 | Canivenc et al. | |
| 6,376,456 | B1 | 4/2002 | Murphy et al. | |
| 6,780,834 | B2 * | 8/2004 | Schramm, Jr. | C11D 1/40 510/515 |
| 6,864,223 | B2 * | 3/2005 | Smith | C11D 1/62 510/475 |
| 7,049,276 | B2 | 5/2006 | Altmann et al. | |
| 7,678,752 | B2 | 3/2010 | Panandiker et al. | |
| 2004/0087469 | A1 | 5/2004 | Carswell | |
| 2004/0116321 | A1 * | 6/2004 | Salesses | C11D 1/62 510/515 |
| 2004/0116322 | A1 * | 6/2004 | Yianakopoulos | C11D 1/62 510/515 |
| 2008/0317788 | A1 | 12/2008 | Louzan Garcia et al. | |
| 2010/0011512 | A1 | 1/2010 | Panandiker et al. | |
| 2010/0325812 | A1 | 12/2010 | Panandiker et al. | |
| 2010/0330020 | A1 | 12/2010 | Panandiker et al. | |
| 2010/0331225 | A1 | 12/2010 | Panandiker et al. | |

FOREIGN PATENT DOCUMENTS

| | | |
|---|---|---|
| CN | 101151299 | 3/2008 |
| CN | 101633781 | 1/2010 |
| EP | 0540557 | 10/1996 |
| EP | 1116813 | 7/2001 |
| EP | 1023429 | 5/2005 |
| EP | 1851298 | 3/2010 |
| GB | 727890 | 4/1955 |
| WO | WO 90/012862 | 11/1990 |
| WO | WO 01/025385 | 4/2001 |
| WO | WO 04/074418 | 9/2004 |
| WO | WO 2004/074418 | * 9/2004 |
| WO | WO 05/042829 | 5/2005 |
| WO | WO 09/127590 | 10/2009 |
| WO | WO 11/032797 | 3/2011 |

OTHER PUBLICATIONS

Provista SA DE CV, "emulsion E101" Technical data sheet, 2006.*
Stessen et al. "Silicones in Household cleaning applications" Chapter in Industrial Applications in Inorganic Polymers, Dr Jager ed. et al. Nova Sciences Publishers www.novapublishers.com Feb. 16, 2009.*
Deutsche Normen, 1972, "Testing of Textiles: Determination of the Crease Recovery Angle of Area-Measured Textiles Method Using an Air-Dry Specimen with Horizontal Fold and erected Free Limb," Methods for Wrinkle Evaluation, DIN53890.
Dow Corning, 1999, "Dow Corning® 531 Fluid" Product Information Sheet.
Henault et al., 2004, "Silicone: Expanding Opportunities for a Performance-Enhancing Material in the Detergent Industry," retrieved from www.dowcorning.com pp. 1-8.
(Continued)

*Primary Examiner* — Amina S Khan

(57) ABSTRACT

A fabric conditioner composition comprising: a cationic fabric softener, and 0.02 to 0.32% by weight of an amino-functional, epoxide group containing silicone polymer having a weight average molecular weight of 400,000 to 900,000 is described. Also, a method of reducing wrinkles on fabric during laundering comprising laundering the fabric with a composition comprising 0.02 to 0.32% by weight of an amino-functional, epoxide group containing silicone polymer having a weight average molecular weight of 400,000 to 900,000 is described. The polymer is unexpectedly effective at low levels of use.

20 Claims, No Drawings

(56) References Cited

OTHER PUBLICATIONS

International Search Report and Written Opinion in International Application No. PCT/US11/051681, dated Apr. 25, 2012.
Jachowicz et al., 1989, "Heterocoagulation of Silicon Emulsions on Keratin Fibers," J. Colloid Interface Sci. 133(1):118-134.
Momentive Performance Materials, 2003, "Bright and Brilliant," Product Portfolio retrieved from www.momentive.com, pp. 1-20.
Provista SA DE CV, 2006, "Emulsion E101," Technical Data Sheet.
Sabia, 1995, "Modification of the Tactile and Physical Properties of Microfiber Fabric Blends with Silicone Polymers," Textile Chemist and Colorist 27(9):79-81.
Stassen, "6: Silicones in Household Cleaning Applications," Chapter: Silicones in Industrial Applications in Inorganic Polymers, Dr Jager, ed. et. al. Nova Science Publishers, www.novapublishers.com.
Written Opinion in International Application No. PCT/US11/051681, dated Sep. 11, 2013.

* cited by examiner

FABRIC WRINKLE REDUCTION COMPOSITION

CROSS-REFERENCE TO RELATED APPLICATIONS

This application is a continuation of U.S. patent application Ser. No. 14/241,437, filed 26 Feb. 2014, which is a U.S. national stage application under 35 U.S.C. § 371 of PCT Application No. PCT/US2011/051681, filed 15 Sep. 2011, which claims priority to U.S. Provisional Patent Application No. 61/527,739, filed 26 Aug. 2011, all of which are incorporated by reference herein in their entireties.

FIELD OF THE INVENTION

The present invention relates to a composition that reduces the number of wrinkles in clothing during laundering.

BACKGROUND OF THE INVENTION

Although wrinkles can be removed by ironing or pressing the garments, ironing is labor and time intensive. There have been attempts to prevent formation of wrinkles during the laundering processes adding amino-functional silicone polymers to fabric conditioners. Typically, these silicone polymers were present in organic solvents. This adds a material to laundering that is not necessary, and the solvents can deposit on clothing. Also, the silicone polymers tended to be of a lower molecular weight of 100,000 or less, and typically, a large amount of silicone polymer was needed to effectively reduce wrinkles, usually at least 5% as is or 1.75% by weight silicone by active weight. It would be desirable to use a low level of polymer for cost savings but still deliver wrinkle reduction.

BRIEF SUMMARY OF THE INVENTION

A fabric conditioner composition comprising a cationic fabric softener, and 0.02 to 0.32% by weight of an amino-functional, epoxide group containing silicone polymer having a weight average molecular weight of 400,000 to 900,000.

A method of reducing wrinkles on fabric during laundering comprising laundering the fabric with a composition comprising 0.02 to 0.32% by weight of an amino-functional, epoxide group containing silicone polymer having a weight average molecular weight of 400,000 to 900,000.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

DETAILED DESCRIPTION OF THE INVENTION

The following description of the preferred embodiment(s) is merely exemplary in nature and is in no way intended to limit the invention, its application, or uses.

Provided is a fabric conditioner composition made by combining a cationic fabric softener, and an amino-functional, epoxide group containing silicone polymer. Also provided is a method of reducing wrinkles on fabric during laundering comprising laundering the fabric with a composition made by combining a cationic fabric softener, and an amino-functional, epoxide group containing silicone polymer.

The laundering can start with machine washing or hand washing. Washing typically includes using a detergent in a wash cycle. Washing is usually followed by a rinse cycle. After washing and rinsing, fabrics can be dried by hanging on a line or in a dryer. The fabric can be ironed after drying.

The method can be used on any type of fabric. In certain embodiments, the fabric is in need of reduced wrinkles. Typical fabrics include any fabric used to make clothing, such as cotton, polyester, elastane, or denim. In certain embodiments, the fabric is denim.

The composition can be used during any step of the laundering method. In one embodiment, the composition is added during the wash cycle. In one embodiment, the composition is added during the rinse cycle. It has been found that multiple launderings can increase the reduction of wrinkles. The fabric can be laundered with the composition for at least 3 times, at least 4 times, or at least 5 times.

The composition includes an amino-functional, epoxide group containing silicone polymer. In certain embodiments, the polymer is 3-aminopropyl-5,6 epoxycyclohexylethyl-dimethyl polysiloxane. In certain embodiments, the amino-functional, epoxide group containing silicone polymer has a weight average molecular weight of 400,000 to 900,000; 450,000 to 850,000; 500,000 to 800,000; or 510,000 to 800,000. In certain embodiments, the ratio of epoxy groups to the total of all groups in the polymer is 1:300 to 1:500 or 1:350 to 1:400. In one embodiment, the amino-functional, epoxide group containing silicone polymer is available from Provista SA de CV of Mexico as E101 silicone.

The combination of the molecular weight with the level of epoxide groups forms a polymer that forms a soft rubber to provide flexibility to the polymer to provide increased wrinkle reduction on fabrics and to make the polymer more easily processed into an emulsion.

In another embodiment, the amino-functional, epoxide group containing silicone polymer has a low amine content, which is 0.1 to 0.25 meq/g. Amine content can be measured by ASTM D2074. The low amine content does not cause yellowing when the polymer is heat treated, such as when in a dryer. The level of amine content is low enough such that there is substantially no yellowing perceivable to a person when viewing a fabric treated with the amino-functional, epoxide group containing silicone polymer. In other embodiments, the amino-functional, epoxide group containing silicone polymer has at least one of the following properties: a small elastomeric level, a low degree of reticulation, low resilience, low tension resistance, or hydrophilicity. The epoxide group can be a free epoxide group, or it can be part of a crosslink in the polymer.

The amino-functional, epoxide group containing silicone polymer is present in an amount of 0.02 to 0.32%. This is a lower level than is typically used for this polymer. In other embodiments, the amount is at least 0.02 up to 0.03, 0.04, 0.05, 0.06, 0.07, 0.08, 0.09, 0.1, 0.15, 0.2, 0.25, or 0.3% by weight. In one embodiment, the amino-functional, epoxide group containing silicone polymer is present in an amount of 0.245% by weight. In other embodiments, the amount is 0.02 to 0.25% by weight of the composition or 0.02 to 0.245% by weight.

Previous amino-functional silicone polymers were solvent based compositions. Solvent based silicone systems introduce solvent into the wash, which can adhere to fabrics. The amino-functional, epoxide group containing silicone polymer can be provided in an emulsion using cationic and/or nonionic surfactants to make the polymer emulsion water dispersible. In certain embodiments, the composition is free of organic solvents. Organic solvents include those for solubilizing amino-functional silicone polymers.

The amino-functional, epoxide group containing silicone polymer can be provided in an emulsion. The polymer can be emulsified by cationic surfactants, nonionic surfactants, or combinations thereof. Examples of cationic surfactants include monoalkyl quaternary ammonium compounds, such as cetyltrimethylammonium chloride. Examples of nonionic surfactants include alkoxylated (ethoxylated) nonionic surfactants, ethoxylated fatty alcohols (Neodol™ surfactants from Shell or Brij™ surfactants from Uniqema), ethoxylated sorbitan fatty acid ester (Tween surfactants from Uniqema), sorbitan fatty acid esters (Span™ surfactants from Uniqema), or ethoxylated fatty acid esters. In one embodiment, the amino-functional, epoxide group containing silicone polymer is available in an emulsion containing a cationic surfactant from Provista SA de CV of Mexico as E101 silicone. In this embodiment, the amount of polymer in the emulsion is 35% by weight. When provided in an emulsion at 35% by weight, the amount of the silicone in the composition is less than 1% by weight.

In certain embodiments, the cationic fabric softener is an esterquat. The esterquats of the following formula:

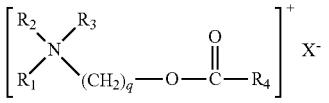

wherein $R_4$ is an aliphatic hydrocarbon group having from 8 to 22 carbon atoms, $R_2$ and $R_3$ represent $(CH_2)_s$—$R_5$, where $R_5$ is an alkoxy carbonyl group containing from 8 to 22 carbon atoms, benzyl, phenyl, $C_1$-$C_{-4}$ alkyl substituted phenyl, OH or H; $R_1$ is $(CH_2)_t$—$R_6$, where $R_6$ is benzyl, phenyl, $C_1$-$C_{-4}$ alkyl substituted phenyl, OH or H; q, s, and t, each independently, are an integer from 1 to 3; and $X^-$ is a softener compatible anion.

The esterquat is produced by reacting about 1.65 (1.5 to 1.75) moles of fatty acid methyl ester with one mole of alkanol amine followed by quaternization with dimethyl sulfate (further details on this preparation method are disclosed in U.S. Pat. No. 3,915,867). Using this ratio controls the amount of each of monoesterquat, diesterquat, and triesterquat in the composition. In certain embodiments, the alkanol amine comprises triethanolamine. In certain embodiments, it is desirable to increase the amount of diesterquat and minimize the amount of triesterquat to increase the softening capabilities of the composition. By selecting a ratio of about 1.65, the triesterquat can be minimized while increasing the monoesterquat.

Monoesterquat is more soluble in water than triesterquat. Depending on the AI, more or less monoesterquat is desired. At higher AI levels (usually at least 7%), more monoesterquat as compared to triesterquat is desired so that the esterquat is more soluble in the water so that the esterquat can be delivered to fabric during use. At lower AI levels (usually up to 3%), less monoesterquat is desired because during use, it is desired for the esterquat to leave solution and deposit on fabric to effect fabric softening. Depending on the AI, the amount of monoesterquat and triesterquat are adjusted to balance solubility and delivery of the esterquat.

In certain embodiments, the reaction products are 50-65 weight % diesterquat, 20-40 weight % monoester, and 25 weight % or less triester, which are shown below:

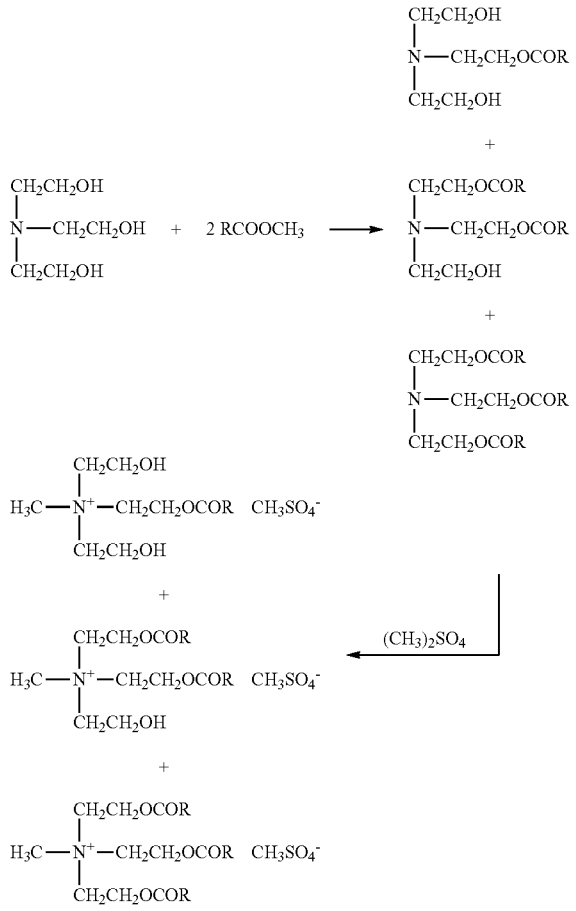

In other embodiments, the amount of diesterquat is 52-60, 53-58, or 53-55 weight %. In other embodiments, the amount of monoesterquat is 30-40 or 35-40 weight %. In other embodiments, the amount of triesterquat is 1-12 or 8-11 weight %.

The percentages, by weight, of mono, di, and tri esterquats, as described above are determined by the quantitative analytical method described in the publication "Characterisation of quaternized triethanolamine esters (esterquats) by HPLC, HRCGC and NMR" A. J. Wilkes, C. Jacobs, G. Walraven and J. M. Talbot—Colgate Palmolive R&D Inc.—4th world Surfactants Congress, Barcelone, 3-7 VI 1996, page 382. The percentages, by weight, of the mono, di and tri esterquats measured on dried samples are normalized on the basis of 100%. The normalization is required due to the presence of 10% to 15%, by weight, of non-quaternized species, such as ester amines and free fatty acids. Accordingly, the normalized weight percentages refer to the pure esterquat component of the raw material. In other words, for the weight % of each of monoesterquat, diesterquat, and triesterquat, the weight % is based on the total amount of monoesterquat, diesterquat, and triesterquat in the composition.

In certain embodiments, the percentage of saturated fatty acids based on the total weight of fatty acids is 45 to 75%. Esterquat compositions using this percentage of saturated fatty acids do not suffer from the processing drawbacks of 100% saturated materials. When used in fabric softening, the compositions provide good consumer perceived fabric softness while retaining good fragrance delivery. In other embodiments, the amount is at least 50, 55, 60, 65 or 70 up to 75%. In other embodiments, the amount is no more than 70, 65, 60, 55, or 50 down to 45%. In other embodiments, the amount is 50 to 70%, 55 to 65%, or 57.5 to 67.5%. In one embodiment, the percentage of the fatty acid chains that are saturated is about 62.5% by weight of the fatty acid. In this embodiment, this can be obtained from a 50:50 ratio of hard:soft fatty acid.

By hard, it is meant that the fatty acid is close to full hydrogenation. In certain embodiments, a fully hydrogenated fatty acid has an iodine value of 10 or less. By soft, it is meant that the fatty acid is no more than partially hydrogenated. In certain embodiments, a no more than partially hydrogenated fatty acid has an iodine value of at least 40. In certain embodiments, a partially hydrogenated fatty acid has an iodine value of 40 to 55. The iodine value can be measured by ASTM D5554-95 (2006). In certain embodiments, a ratio of hard fatty acid to soft fatty acid is 70:30 to 40:60. In other embodiments, the ratio is 60:40 to 40:60 or 55:45 to 45:55. In one embodiment, the ratio is about 50:50. Because in these specific embodiments, each of the hard fatty acid and soft fatty acid cover ranges for different levels of saturation (hydrogenation), the actual percentage of fatty acids that are fully saturated can vary. In certain embodiments, soft tallow contains approximately 47% saturated chains by weight.

The percentage of saturated fatty acids can be achieved by using a mixture of fatty acids to make the esterquat, or the percentage can be achieved by blending esterquats with different amounts of saturated fatty acids.

The fatty acids can be any fatty acid that is used for manufacturing esterquats for fabric softening. Examples of fatty acids include, but are not limited to, coconut oil, palm oil, tallow, rape oil, fish oil, or chemically synthesized fatty acids. In certain embodiments, the fatty acid is tallow.

While the esterquat can be provided in solid form, it is usually present in a solvent in liquid form. In solid form, the esterquat can be delivered from a dryer sheet in the laundry. In certain embodiments, the solvent comprises water.

AI refers to the active weight of the combined amounts for monoesterquat, diesterquat, and triesterquat. Delivered AI refers to the mass (in grams) of esterquat used in a laundry load. A load is 3.5 kilograms of fabric in weight. As the size of a load changes, for example using a smaller or larger size load in a washing machine, the delivered AI adjusts proportionally. In certain embodiments, the delivered AI is 2.8 to 8 grams per load. In other embodiments, the delivered AI is 2.8 to 7, 2.8 to 6, 2.8 to 5, 3 to 8, 3 to 7, 3 to 6, 3 to 5, 4 to 8, 4 to 7, 4 to 6, or 4 to 5 grams per load.

The composition can be provided as a fragrance free composition, or it can contain a fragrance. The amount of fragrance can be any desired amount depending on the preference of the user. In certain embodiments, the total amount of fragrance oil is 0.3 to 3 weight % of the composition. The fragrance can be in free form, encapsulated, or both.

Fragrance, or perfume, refers to odoriferous materials that are able to provide a desirable fragrance to fabrics, and encompasses conventional materials commonly used in detergent compositions to provide a pleasing fragrance and/or to counteract a malodor. The fragrances are generally in the liquid state at ambient temperature, although solid fragrances can also be used. Fragrance materials include, but are not limited to, such materials as aldehydes, ketones, esters and the like that are conventionally employed to impart a pleasing fragrance to laundry compositions. Naturally occurring plant and animal oils are also commonly used as components of fragrances.

The composition can contain any material that can be added to fabric softeners. Examples of materials include, but are not limited to, surfactants, thickening polymers, colorants, clays, buffers, silicones, fatty alcohols, and fatty esters.

The fabric conditioners may additionally contain a thickener. In one embodiment, the thickening polymer is the FLOSOFT™ DP200 polymer from SNF Floerger that is described in U.S. Pat. No. 6,864,223 to Smith et al., which is sold as FLOSOFT™ DP200, which as a water soluble cross-linked cationic polymer derived from the polymerization of from 5 to 100 mole percent of cationic vinyl addition monomer, from 0 to 95 mole percent of acrylamide, and from 70 to 300 ppm of a difunctional vinyl addition monomer cross-linking agent. A suitable thickener is a water-soluble cross-linked cationic vinyl polymer which is cross-linked using a cross-linking agent of a difunctional vinyl addition monomer at a level of from 70 to 300 ppm, preferably from 75 to 200 ppm, and most preferably of from 80 to 150 ppm. These polymers are further described in U.S. Pat. No. 4,806,345, and other polymers that may be utilized are disclosed in WO 90/12862. Generally, such polymers are prepared as water-in-oil emulsions, wherein the cross-linked polymers are dispersed in mineral oil, which may contain surfactants. During finished product making, in contact with the water phase, the emulsion inverts, allowing the water soluble polymer to swell. The most preferred thickener is a cross-linked copolymer of a quaternary ammonium acrylate or methacrylate in combination with an acrylamide comonomer. The thickener in accordance provides fabric softening compositions showing long term stability upon storage and allows the presence of relatively high levels of electrolytes without affecting the composition stability. Besides, the fabric softening compositions remain stable when shear is applied thereto. In certain embodiments, the amount of this thickening polymer is at least 0.001 weight %. In other embodiments, the amount is 0.001 to 0.35 weight %.

The fabric conditioner may further include a chelating compound. Suitable chelating compounds are capable of chelating metal ions and are present at a level of at least 0.001%, by weight, of the fabric softening composition, preferably from 0.001% to 0.5%, and more preferably 0.005% to 0.25%, by weight. The chelating compounds which are acidic in nature may be present either in the acidic form or as a complex/salt with a suitable counter cation such as an alkali or alkaline earth metal ion, ammonium or substituted ammonium ion or any mixtures thereof. The chelating compounds are selected from among amino carboxylic acid compounds and organo aminophosphonic acid compounds, and mixtures of same. Suitable amino carboxylic acid compounds include: ethylenediamine tetraacetic acid (EDTA); N-hydroxyethylenediamine triacetic acid; nitrilotriacetic acid (NTA); and diethylenetriamine pentaacetic acid (DEPTA). Suitable organo aminophosphonic acid compounds include: ethylenediamine tetrakis (methylenephosphonic acid); 1-hydroxyethane 1,1-diphosphonic acid (HEDP); and aminotri (methylenephosphonic acid). In certain embodiments, the composition can include amino tri methylene phosphonic acid, which is available as Dequest™ 2000 from Monsanto. In other embodiments, the composition can include glutamic acid, N,N-diacetic acid, tetra sodium salt, which is available as Dissolvine™ GL from AkzoNobel.

In certain embodiments, the composition can include a $C_{13}$-$C_{15}$ Fatty Alcohol EO 20:1, which is a nonionic surfactant with an average of 20 ethoxylate groups. In certain embodiments, the amount is 0.05 to 0.5 weight %.

In certain embodiments, the composition can contain a silicone as a defoamer, such as Dow Corning™ 1430 defoamer. In certain embodiments, the amount is 0.05 to 0.8 weight %.

In certain embodiments, the composition reduces the number of wrinkles by at least 5, 10, 15, 20, 25, 30, 35, 40, 45, 50, 55, 60, 65, 70, 75, 80, 85, 90, or 95% as compared to the number of wrinkles without the use of the water soluble silicone. Wrinkle evaluation can be conducted as per DIN 53890.

SPECIFIC EMBODIMENTS

Example 1

In the example below, the amounts of material are based on the as supplied weight of the material.

| Material (weight %) | Example |
|---|---|
| Tetranyl ™ AHT5090 Esterquat from Kao | 5.9 |
| Lactic acid (80% active) | 0.0625 |
| Dequest ™ 2000 amino trimethyl phosphonic acid | 0.1 |
| FLOSOFT ™ DP200 thickening polymer | 0.24 |
| E101 amino-functional, epoxide group containing silicone polymer from Provista (35% active) | 0.7 |
| Water and minors (fragrance, preservative, color) about 85.5% water | Q.S. to 100 |

Preparation Method

Weigh required amount of distilled water in a beaker. Add amino trimethyl phosphonic acid, and lactic acid to water and mix. Add amino-functional, epoxide group containing silicone polymer. Heat to 60° C. Stir the solution using an overhead stirrer at 250 RPM for 2 minutes. In a beaker, heat esterquat to 65° C. Add esterquat into solution while stirring at 400 RPM. Mix the solution for 10 minutes. Add SNF™ polymer into the solution and stir for 10 minutes. Check the temperature of the mixture. On cooling to room temperature, add any fragrance drop wise.

Fabric Treatment with Fabric Softener

Prepare an approximate 1.8 kg load containing 3 denim swatches (Kaltex 100% cotton denim, 200 mm×200 mm) without ballast, per product to be tested (washing machine). Swatches washed with an automatic washing machine using the composition of the Example in the fabric softener cycle. As a comparison, another set of the swatches are also washed but without adding the fabric treatment composition of the present invention.

Using a marking pen, label swatches with respective product & type of drying identification code.

Weigh out detergent samples and fabric softener for each wash.

Washing machine(s) should be cleaned by conducting a wash cycle at 70° C.

| | |
|---|---|
| Washer Type | Front Loading |
| Wash Cycle | Custom - 40° C., "Fast" Centrifugation |
| Wash Time | 8 minutes |

-continued

| | |
|---|---|
| Water Level | 45 liters used for all wash and rinse cycles |
| Wash Temperature | 40° C. |
| Rinse Temperature | Room Temperature |
| Spin Speed | 1200 RPM |
| Laundry Load Size | 1.8 Kg |
| Detergent | Ariel ™ Professional detergent from Europe |
| Dosage | 33 g |
| Fabric Softener | 77 g |

Set wash controls for custom cycle with specified wash period. Add detergent and fabric softener to respective compartments in washing machine. Add swatches to washing machine.

Start wash cycle

Wash for specified amount of time

Wrinkles on Fabrics

The washing machine is stopped just before the last spinning cycle, and the swatches are removed from the washing machine. Each swatch is folded twice length wise, and hand wrung to remove water. The wrung swatch is opened and shaken three times by grabbing two corners of the swatch. Swatches are returned to the final spin cycle. Swatches are removed and hung to dry. Each dried swatch is evaluated for the number of visually perceptive wrinkles within a 60 $cm^2$ circle at the center of the swatch. The table below lists the average number of wrinkles.

| | |
|---|---|
| Wrinkles from using the composition of the Example | 9.6 |
| Wrinkles not using the composition | 24.2 |

The percent wrinkle reduction is (24.2-9.6)/24.2*100=60.3%.

As can be seen from the data above, the amino-functional, epoxide group containing silicone polymer that is present in an amount of less than 1% by weight (as supplied) of the composition reduces the number of wrinkles. Also, solvent is not added to the composition. It was surprising that such a low level would be able to reduce wrinkles. When compared to a recommended amount of 5% by weight as supplied, this usage is a reduction of over 5 times from the recommended amount.

Example 2

The composition from Example 1 is prepared along with a composition that has 5% by weight of the E101 amino-functional, epoxide group containing silicone polymer from Provista (35% active). The laundering procedure for Example 1 is followed for the two compositions along with laundering not using either composition. The compositions are used with gabardine fabric and denim fabric. The wrinkle results are in the table below.

| Composition | Gabardine | Denim |
|---|---|---|
| Wrinkles from using the composition of with 0.7% | 5.6 | 6.8 |
| Wrinkles from using the comparative composition of the with 5% | 5.8 | 7.2 |
| Wrinkles not using the composition | 20.8 | 27.5 |

Surprisingly, it is discovered that using the amino-functional, epoxide group containing silicone polymer that is present in an amount of less than 1% by weight (as supplied)

of the composition reduces the number of wrinkles in about the same amount as a composition that has 5% by weight (as supplied). It is unexpected that such a low level would produce the same results as the higher level of usage.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

Unless otherwise specified, all percentages and amounts expressed herein and elsewhere in the specification should be understood to refer to percentages by weight. The amounts given are based on the active weight of the material.

What is claimed is:

1. A fabric conditioner composition comprising:

a cationic fabric softener, which is an esterquat having the formula:

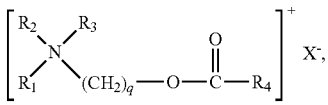

wherein:

$R_4$ is an aliphatic hydrocarbon group having from 8 to 22 carbon atoms, $R_2$ and $R_3$ represent $(CH_2)_S$—$R_5$, $R_5$ is an alkoxy carbonyl group containing from 8 to 22 carbon atoms, benzyl, phenyl, $C_1$-$C_4$ alkyl substituted phenyl, OH, or H, $R_6$ is benzyl, phenyl, $C_1$-$C_4$ alkyl substituted phenyl, OH, or H, q, s, and t, are each independently an integer from 1 to 3, and $X^-$ is a softener compatible anion; and 0.02 to 0.04% by weight of an amino-functional, epoxide group containing silicone polymer having a weight average molecular weight of 400,000 to 900,000 that exhibits a capability of reducing the number of fabric wrinkles same as a composition that has 5% by weight of the same silicone polymer.

2. The fabric conditioner composition of claim 1, wherein the esterquats comprise 20-40 wt % monoesterquats, 50-65 wt % diesterquats, and 25 wt % or less of triesterquats.

3. The fabric conditioner composition of claim 1, wherein the amino-functional, epoxide group containing silicone polymer comprises 3-aminopropyl-5,6 epoxycyclohexyl-ethyl-dimethyl polysiloxane.

4. The fabric condition composition of claim 1, further comprising lactic acid.

5. The fabric conditioner composition of claim 1, wherein the fabric conditioner composition is an aqueous composition, and wherein the fabric conditioner composition is free of organic solvents.

6. The fabric conditioner composition of claim 1, wherein the amino-functional, epoxide group containing silicone polymer has a weight average molecular weight of 450,000 to 850,000.

7. The fabric conditioner composition of claim 6, wherein the amino-functional, epoxide group containing silicone polymer has an epoxy content of 1:350 to 1:400.

8. The fabric conditioner composition of claim 7, wherein the amino-functional, epoxide group containing silicone polymer has an amine content of 0.1 to 0.25 meq/g.

9. The fabric conditioner composition of claim 8, wherein the amino-functional, epoxide group containing silicone polymer is in the form of an emulsion that is mixed with the cationic fabric softener.

10. The fabric conditioner composition of claim 9, wherein the emulsion comprises:

the amino-functional, epoxide group containing silicone polymer; and a cationic surfactant.

11. The fabric conditioner composition of claim 1, which comprises:

a cationic fabric softener comprising an esterquat;

0.02 to 0.04% by weight of an amino-functional, epoxide group containing silicone polymer having a weight average molecular weight of 400,000 to 900,000 that exhibits a capability of reducing the number of fabric wrinkles same as a composition that has 5% by weight of the same silicone polymer;

lactic acid;

a chelating compound; and water.

12. The fabric conditioner composition of claim 11, wherein the chelating compound is amino trimethyl phosphonic acid.

13. The fabric conditioner composition of claim 11, further comprising minors selected from fragrance, preservative and color.

14. A method of reducing wrinkles on fabric during laundering comprising laundering the fabric with the fabric conditioner composition of claim 1, wherein the fabric is in need of reduced wrinkles.

15. The method of claim 14, wherein the fabric is laundered at least 3 times.

16. The method of claim 15, wherein laundering the fabric with the fabric conditioner composition comprises:

washing in a wash cycle with a detergent; and rinsing in a rinse cycle.

17. The method of claim 16, wherein the composition is added during the rinse cycle.

18. The method of claim 16, wherein the composition is added during the wash cycle.

19. The method of claim 15, wherein laundering the fabric with the fabric conditioner composition further comprises drying the fabric.

20. The method of claim 14, wherein the method reduces the number of wrinkles by at least 5% as compared to a number of wrinkles without the use of the amino-functional, epoxide group containing silicone polymer.

* * * * *